US010565923B2

(12) United States Patent
Shen et al.

(10) Patent No.: US 10,565,923 B2
(45) Date of Patent: Feb. 18, 2020

(54) COMMON-MODE NOISE COMPENSATION

(71) Applicant: Apple Inc., Cupertino, CA (US)

(72) Inventors: Shiping Shen, Cupertino, CA (US); Derek K. Shaeffer, Redwood City, CA (US); Baris Cagdaser, Sunnyvale, CA (US); Hyunwoo Nho, Stanford, CA (US); Kingsuk Brahma, Mountain View, CA (US); Hung Sheng Lin, San Jose, CA (US); Injae Hwang, Minato-ku (JP); Jie Won Ryu, Campbell, CA (US); Hyunsoo Kim, Stanford, CA (US); Junhua Tan, Santa Clara, CA (US); Rui Zhang, Sunnyvale, CA (US); Shengkui Gao, San Jose, CA (US); Mohammad B Vahid Far, San Jose, CA (US); Jesse A. Richmond, San Francisco, CA (US); Sun-Il Chang, San Jose, CA (US)

(73) Assignee: Apple Inc., Cupertino, CA (US)

( * ) Notice: Subject to any disclaimer, the term of this patent is extended or adjusted under 35 U.S.C. 154(b) by 199 days.

(21) Appl. No.: 15/700,971

(22) Filed: Sep. 11, 2017

(65) Prior Publication Data

US 2018/0342193 A1 Nov. 29, 2018

Related U.S. Application Data

(60) Provisional application No. 62/511,812, filed on May 26, 2017.

(51) Int. Cl.

| | |
|---|---|
| ***G09G 3/20*** | (2006.01) |
| ***G09G 3/3233*** | (2016.01) |
| ***G09G 3/36*** | (2006.01) |

(52) U.S. Cl.
CPC ..... *G09G 3/2092* (2013.01); *G09G 3/3233* (2013.01); *G09G 3/3648* (2013.01); (Continued)

(58) Field of Classification Search
CPC .... G09G 3/2092; G09G 3/006; G09G 3/3233; G09G 3/3648; G09G 3/3225
See application file for complete search history.

(56) References Cited

U.S. PATENT DOCUMENTS

2013/0314394 A1* 11/2013 Chaji ..... G09G 3/00 345/212
2015/0009204 A1 1/2015 Chaji
(Continued)

OTHER PUBLICATIONS

International Search Report and Written Opinion for PCT Application No. PCT/US2018/027356 dated Jul. 11, 2018; 16 pgs.

*Primary Examiner* — Sardis F Azongha
(74) *Attorney, Agent, or Firm* — Fletcher Yoder PC

(57) ABSTRACT

Electronic devices and methods for compensating for noise in a display that includes sensing a current in a sensing channel of the display. Compensating for the noise also includes sensing an observation current from noise in an observation channel of the display and scaling the observation current to generate a scaled observation current. The scaled observation current is subtracted from the sense current to generate a compensated output. The compensated output is used to drive compensation operations of the display based at least in part on the compensated output to reduce effects of the noise.

19 Claims, 11 Drawing Sheets

(52) U.S. Cl.
CPC ..... *G09G 2320/0693* (2013.01); *G09G 2330/021* (2013.01); *G09G 2330/12* (2013.01)

(56) References Cited

U.S. PATENT DOCUMENTS

| | | | |
|---|---|---|---|
| 2015/0138177 | A1 | 5/2015 | Kwon et al. |
| 2016/0078805 | A1 | 3/2016 | Woo et al. |

* cited by examiner

COMMON-MODE NOISE COMPENSATION

CROSS REFERENCE TO RELATED APPLICATIONS

This application is a Non-Provisional application claiming priority to U.S. Provisional Patent Application No. 62/511,812, entitled "Common-Mode Noise Compensation", filed May 26, 2017, which is herein incorporated by reference.

BACKGROUND

The present disclosure relates generally to techniques to cancelling noise resultant in a display. More specifically, the present disclosure relates generally to techniques for noise compensation of external common-mode noise in pixels that may be resistant to filtering correction.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic display panels are used in a plethora of electronic devices. These display panels typically consist of multiple pixels that emit light. These pixels may be formed using self-emissive units (e.g., light emitting diode) or pixels that utilize units that are backlit (e.g., liquid crystal diode). These displays may include noise filtering as non-uniformity compensation to reduce noise at each pixel of the display. However, filtering pixels may miss external noise and/or error sources, such as capacitively coupled fluctuations in local supply voltage resulting in a common-mode error. Indeed, filtering may generate erroneous correction values that compromise the effectiveness of the non-uniformity compensation.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

To address common-mode error, when parameters (e.g., current) of one or more pixels are being sensed through a channel (i.e., the sensing channel), one or more nearby pixels is also sensed through its own channel (i.e., the observation channel) while keeping the pixel emission off for the observation channel. Sensed parameter values from the observation channel are scaled according to the relative mismatches of the sensing and observation channels as determined through an initial calibration process. The scaled parameter may be subtracted from the sensed current value in the sensing channel to determine a compensated sensing value.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
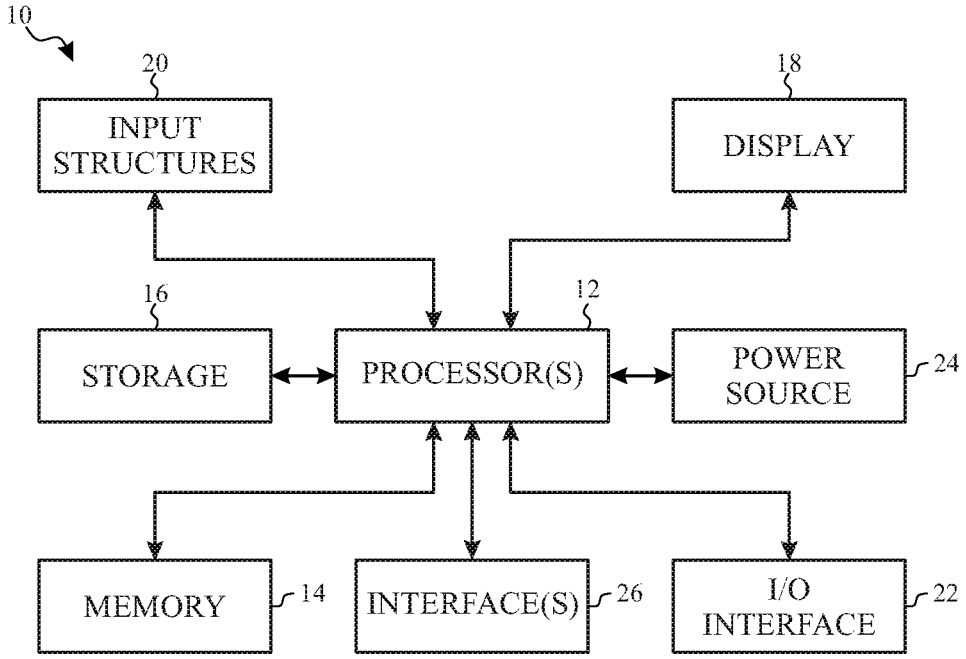
FIG. 1 is a schematic block diagram of an electronic device including a display, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Display panel uniformity can be improved by estimating or measuring a parameter (e.g., current) through pixel, such as an organic light emitting diode (LED). Based on the measured parameter, a corresponding correction value may be applied to compensate for any offsets from an intended value. Per-pixel sensing schemes can employ the use of filters and other processing steps to help reduce or eliminate the unwanted effects of pixel leakage, noise, and other error sources. Although the application generally relates to sensing individual pixels, some embodiments may group pixels for sensing and observation such that at least one channel senses more than a single pixel. However, some external noise and error sources, such as capacitively coupled fluctuations in local supply voltage that result in common-mode error, may not be fully removable through the filtering process, resulting in erroneous correction values that compromise the effectiveness of the non-uniformity compensation. Moreover, this common-mode error is amplified by the inherent mismatches of parasitic capacitance values between different sensing channels within a display as a result of imperfect device process variations.

To address this common-mode error, when a given pixel current is being sensed through a channel (i.e., the sensing channel), a nearby pixel is also sensed through its own channel (i.e., the observation channel) while keeping the pixel emission off for the observation channel. Sensed parameter (e.g., current) value from the observation channel is scaled according to the relative mismatches of the sensing and observation channels as determined through an initial calibration process. Then, the scaled parameter is subtracted from the sensed current value from the sensing channel to determine a compensated sensing value.

The proximity of the nearby pixel, and hence the observation channel, is dependent on the accuracy level to be used in the system and correspondingly determines the spatial correlation to be used to achieve this accuracy level.

The differential input mismatch of the observation channel may be adjustable to ensure that the component of the sensed value attributed to noise and error is higher in the observation channel than it is in the sensing channel. Sensing from both the sensing channel and observation channel may occur at the same time to establish high time correlation. Moreover, the observation channel and/or the sensing channel may utilize single-ended and/or differential sensing channels.

With the foregoing in mind and referring first to FIG. 1, an electronic device 10 according to an embodiment of the present disclosure may include, among other things, one or more processor(s) 12, memory 14, nonvolatile storage 16, a display 18, input structures 20, an input/output (I/O) interface 22, a power source 24, and interface(s) 26. The various functional blocks shown in FIG. 1 may include hardware elements (e.g., including circuitry), software elements (e.g., including computer code stored on a computer-readable medium) or a combination of both hardware and software elements. It should be noted that FIG. 1 is merely one example of a particular implementation and is intended to illustrate the types of components that may be present in electronic device 10.

In the electronic device 10 of FIG. 1, the processor(s) 12 and/or other data processing circuitry may be operably coupled with the memory 14 and the nonvolatile storage 16 to perform various algorithms. Such programs or instructions, including those for executing the techniques described herein, executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and/or optical discs. Also, programs (e.g., an operating system) encoded on such a computer program product may also include instructions that may be executed by the processor(s) 12 to enable the electronic device 10 to provide various functionalities.

In certain embodiments, the display 18 may be a liquid crystal display (e.g., LCD), which may allow users to view images generated on the electronic device 10. In some embodiments, the display 18 may include a touch screen, which may allow users to interact with a user interface of the electronic device 10. Furthermore, it should be appreciated that, in some embodiments, the display 18 may include one or more light emitting diode (e.g., LED) displays, or some combination of LCD panels and LED panels.

The input structures 20 of the electronic device 10 may enable a user to interact with the electronic device 10 (e.g., pressing a button to increase or decrease a volume level, a camera to record video or capture images). The I/O interface 22 may enable the electronic device 10 to interface with various other electronic devices. Additionally or alternatively, the I/O interface 22 may include various types of ports that may be connected to cabling. These ports may include standardized and/or proprietary ports, such as USB, RS232, Apple's Lightning® connector, as well as one or more ports for a conducted RF link.

As further illustrated, the electronic device 10 may include the power source 24. The power source 24 may include any suitable source of power, such as a rechargeable lithium polymer (e.g., Li-poly) battery and/or an alternating current (e.g., AC) power converter. The power source 24 may be removable, such as a replaceable battery cell.

The interface(s) 26 enable the electronic device 10 to connect to one or more network types. The interface(s) 26 may also include, for example, interfaces for a personal area network (e.g., PAN), such as a Bluetooth network, for a local area network (e.g., LAN) or wireless local area network (e.g., WLAN), such as an 802.11 Wi-Fi network or an 802.15.4 network, and/or for a wide area network (e.g., WAN), such as a 3rd generation (e.g., 3G) cellular network, 4th generation (e.g., 4G) cellular network, or long term evolution (e.g., LTE) cellular network. The interface(s) 26 may also include interfaces for, for example, broadband fixed wireless access networks (e.g., WiMAX), mobile broadband Wireless networks (e.g., mobile WiMAX), and so forth.

Figure 2:
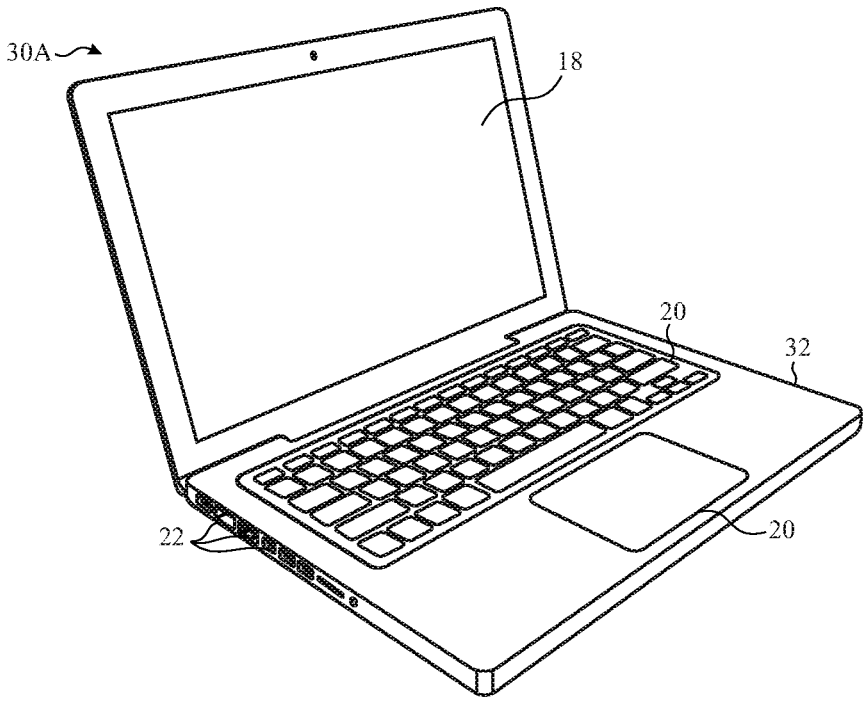
FIG. 2 is a perspective view of a notebook computer representing an embodiment of the electronic device of FIG. 1, in accordance with an embodiment.
Figure 3:
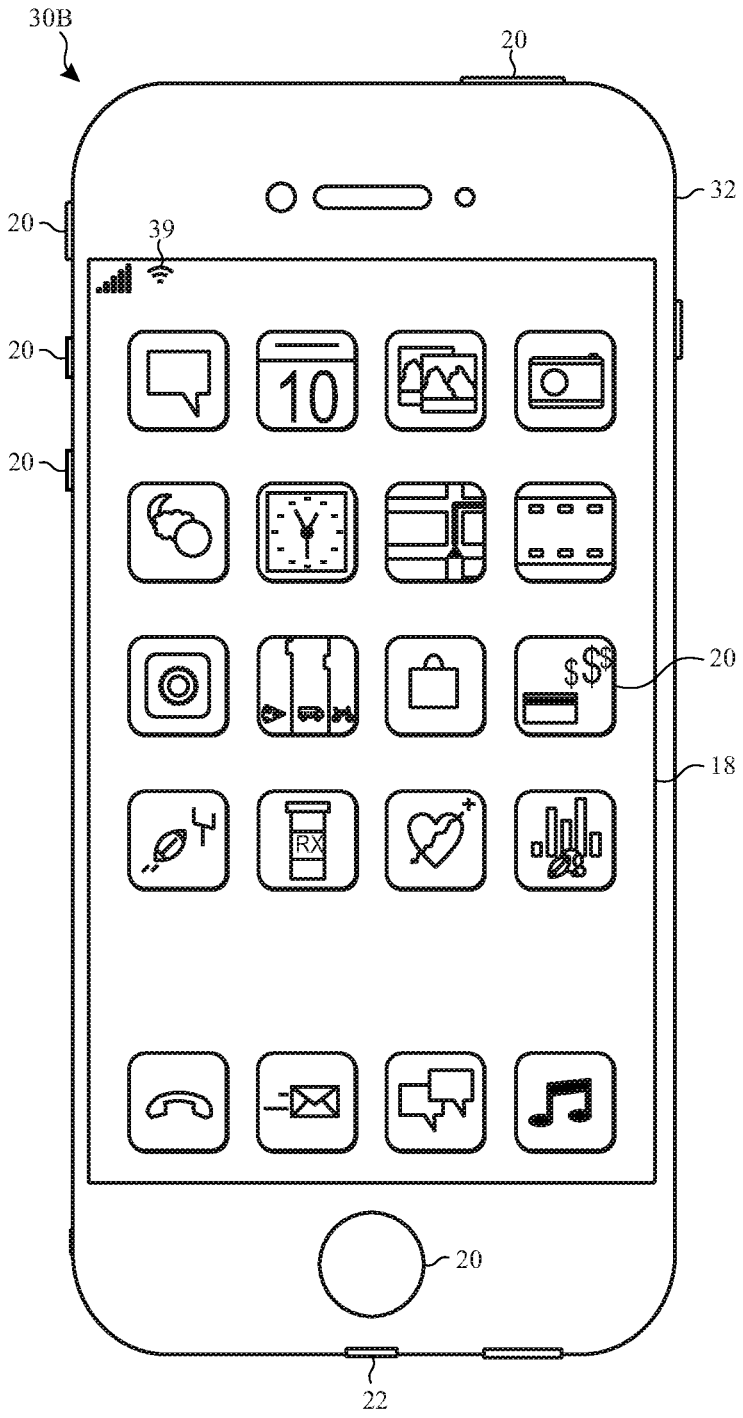
FIG. 3 is a front view of a hand-held device representing another embodiment of the electronic device of FIG. 1, in accordance with an embodiment.
Figure 4:
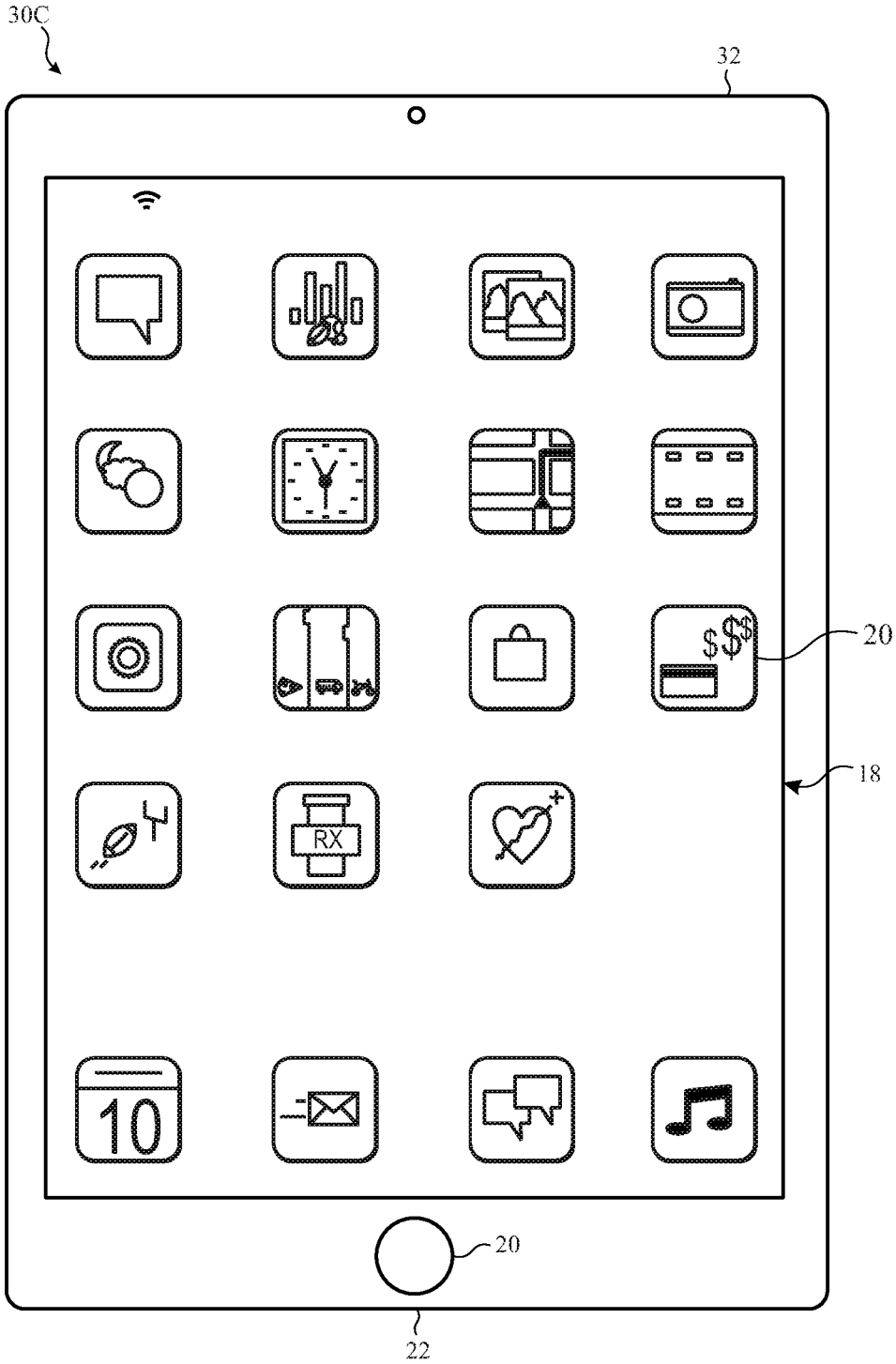
FIG. 4 is a front view of another hand-held device representing another embodiment of the electronic device of FIG. 1, in accordance with an embodiment.
Figure 5:
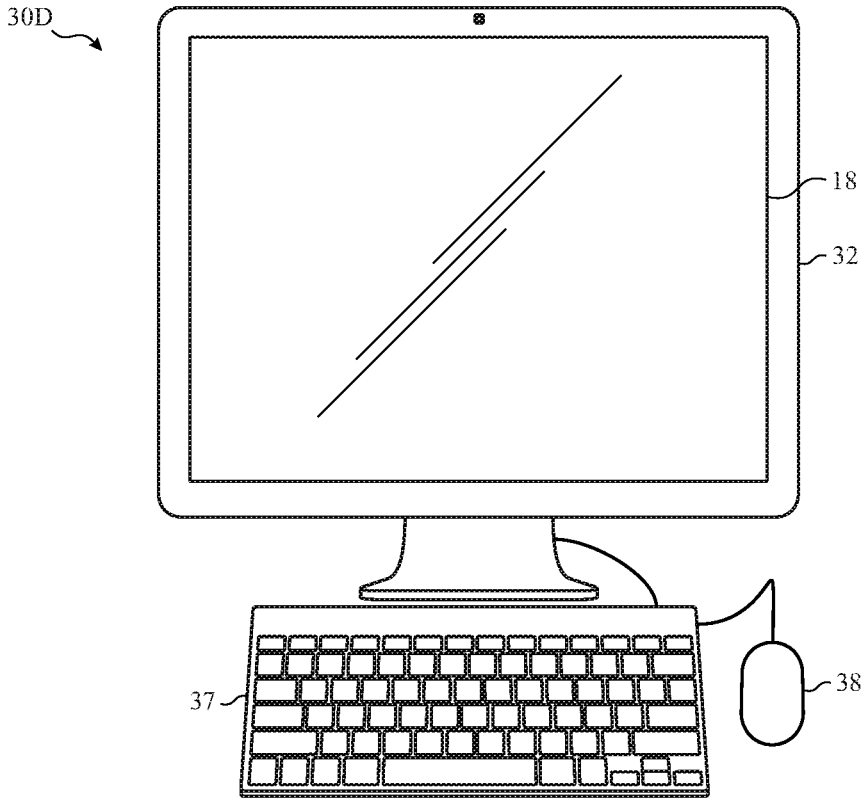
FIG. 5 is a front view of a desktop computer representing another embodiment of the electronic device of FIG. 1, in accordance with an embodiment.
Figure 6:
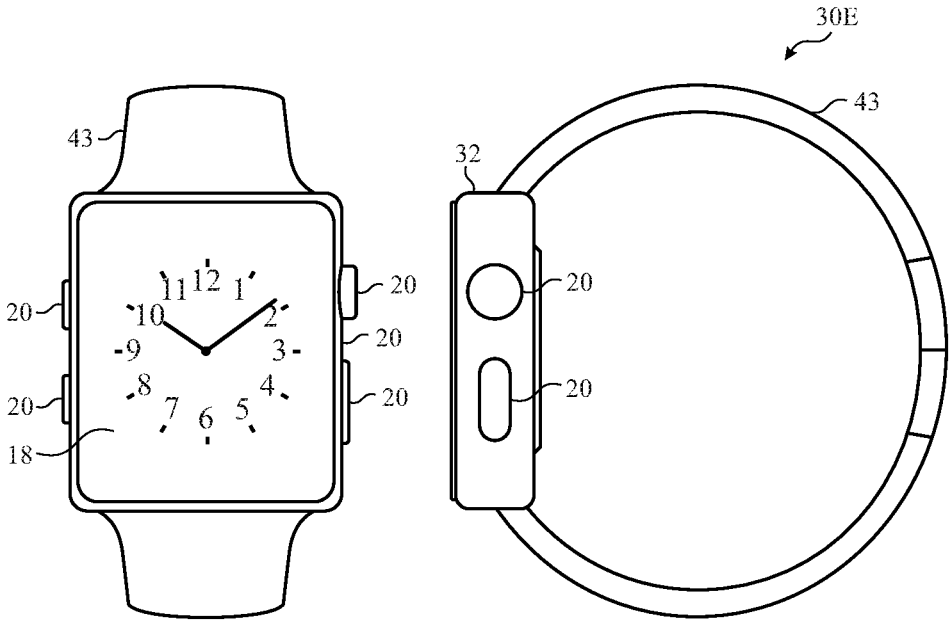
FIG. 6 is a front view of a wearable electronic device representing another embodiment of the electronic device of FIG. 1, in accordance with an embodiment.

By way of example, the electronic device 10 may represent a block diagram of the notebook computer depicted in FIG. 2, the handheld device depicted in either of FIG. 3 or FIG. 4, the desktop computer depicted in FIG. 5, the wearable electronic device depicted in FIG. 6, or similar devices. It should be noted that the processor(s) 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In certain embodiments, the electronic device 10 may take the form of a computer, a portable electronic device, a wearable electronic device, or other type of electronic device. Such computers may include computers that are generally portable (e.g., such as laptop, notebook, and tablet computers) as well as computers that are generally used in one place (e.g., such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include a housing or enclosure 32, a display 18, input structures 20, and ports of the I/O interface 22. In one embodiment, the input structures 20 (e.g., such as a keyboard and/or touchpad) may be used to interact with the computer 30A, such as to start, control, or operate a GUI or applications running on computer 30A. For example, a keyboard and/or touchpad may allow a user to navigate a user interface or application interface displayed on display 18.

FIG. 3 depicts a front view of a handheld device 30B, which represents one embodiment of the electronic device 10. The handheld device 30B may represent, for example, a portable phone, a media player, a personal data organizer, a handheld game platform, or any combination of such devices. By way of example, the handheld device 30B may be a model of an iPod® or iPhone® available from Apple Inc. of Cupertino, Calif.

The handheld device 30B may include an enclosure 32 to protect interior components from physical damage and to shield them from electromagnetic interference. The enclosure 32 may surround the display 18, which may display indicator icons. The indicator icons may indicate, among other things, a cellular signal strength, Bluetooth connection, and/or battery life. The I/O interfaces 22 may open through the enclosure 32 and may include, for example, an I/O port for a hard-wired connection for charging and/or content manipulation using a connector and protocol, such as the Lightning connector provided by Apple Inc., a universal serial bus (e.g., USB), one or more conducted RF connectors, or other connectors and protocols.

The illustrated embodiments of the input structures 20, in combination with the display 18, may allow a user to control the handheld device 30B. For example, a first input structure 20 may activate or deactivate the handheld device 30B, one of the input structures 20 may navigate user interface to a home screen, a user-configurable application screen, and/or activate a voice-recognition feature of the handheld device 30B, while other of the input structures 20 may provide volume control, or may toggle between vibrate and ring modes. Additional input structures 20 may also include a microphone that may obtain a user's voice for various voice-related features, and a speaker to allow for audio playback and/or certain phone capabilities. The input structures 20 may also include a headphone input (not illustrated) to provide a connection to external speakers and/or headphones and/or other output structures.

FIG. 4 depicts a front view of another handheld device 30C, which represents another embodiment of the electronic device 10. The handheld device 30C may represent, for example, a tablet computer, or one of various portable computing devices. By way of example, the handheld device 30C may be a tablet-sized embodiment of the electronic device 10, which may be, for example, a model of an iPad® available from Apple Inc. of Cupertino, Calif.

Turning to FIG. 5, a computer 30D may represent another embodiment of the electronic device 10 of FIG. 1. The computer 30D may be any computer, such as a desktop computer, a server, or a notebook computer, but may also be a standalone media player or video gaming machine. By way of example, the computer 30D may be an iMac®, a MacBook®, or other similar device by Apple Inc. It should be noted that the computer 30D may also represent a personal computer (e.g., PC) by another manufacturer. A similar enclosure 32 may be provided to protect and enclose internal components of the computer 30D such as the display 18. In certain embodiments, a user of the computer 30D may interact with the computer 30D using various peripheral input devices, such as the keyboard 37 or mouse 38, which may connect to the computer 30D via an I/O interface 22.

Similarly, FIG. 6 depicts a wearable electronic device 30E representing another embodiment of the electronic device 10 of FIG. 1 that may be configured to operate using the techniques described herein. By way of example, the wearable electronic device 30E, which may include a wristband 43, may be an Apple Watch® by Apple, Inc. However, in other embodiments, the wearable electronic device 30E may include any wearable electronic device such as, for example, a wearable exercise monitoring device (e.g., pedometer, accelerometer, heart rate monitor), or other device by another manufacturer. The display 18 of the wearable electronic device 30E may include a touch screen (e.g., LCD, an organic light emitting diode display, an active-matrix organic light emitting diode (e.g., AMOLED) display, and so forth), which may allow users to interact with a user interface of the wearable electronic device 30E.

Although the following discusses sensing current through an OLED as a pixel, some embodiments may include measuring other parameters suitable for other pixel types. For example, LED voltage may be sensed at LED pixels near each other in the display.

Figure 7:
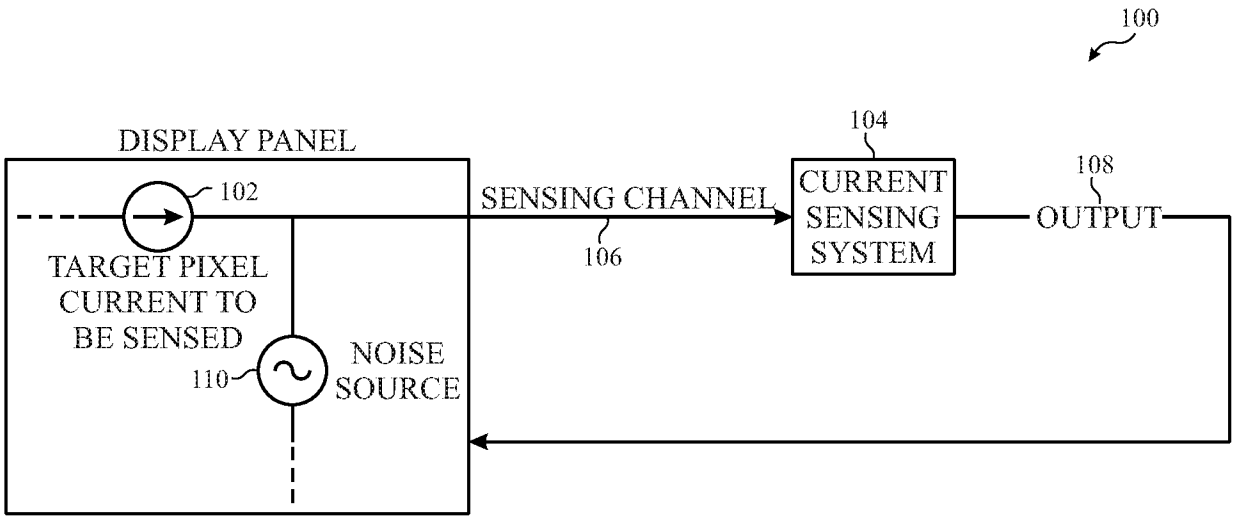
FIG. 7 illustrates a block diagram view of a single-channel current sensing scheme, in accordance with an embodiment.

FIG. 7 illustrates a block diagram view of a single-channel current sensing scheme 100. As illustrated, a target pixel current is provided via a current source 102. The current provided by the current source 102 then is supplied to a current sensing system 104 via a sensing channel 106. The sensing channel 106 may include a single-ended or a differential channel. The current sensing system 104 then outputs an output 108 that is used to compensate display panel operation. In other words, in the single-channel current sensing scheme 100, a single channel 106 is used to detect or estimate pixel current directly from a target pixel. Furthermore, the single-channel current sensing scheme 100 may include amplifiers, filters, analog-to-digital converters, digital-to-analog converters, and/or other circuitry used for processing in the single-channel current sensing scheme 100 that have been omitted from FIG. 7 for clarity.

The single-channel current sensing scheme 100 detects at least some issues for the target pixel. But, common-mode noise sources, such as the noise source 110, may be picked up by the current sensing system 104 and converted into differential input by any inherent mismatches in the sensing channel 106. This differential input may result in an error in the sensed current and a resultant error in the pixel current compensation of the output 108.

Figure 8:
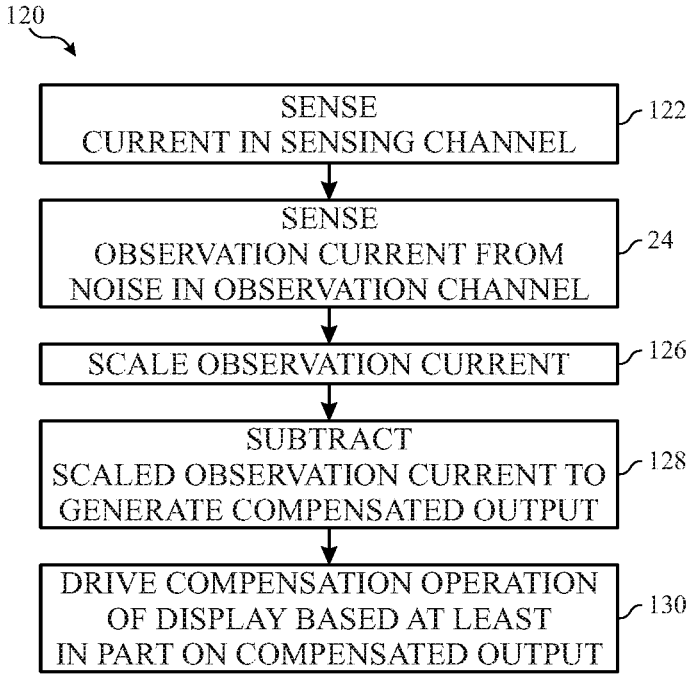
FIG. 8 illustrates a flow diagram of a process for sensing a current using two channels, in accordance with an embodiment.

Instead of using a single channel to sense current, two channels may be used. FIG. 8 illustrates a flow diagram of a process 120 for sensing a current using two channels. In a sensing channel of a display, a current is sensed through the sensing channel from a target current is driven from a current source (block 122). An observation channel of the display is used to detect observation current attributable to noise, such as common-mode noise across the observation and sensing channels (block 124). In an observation channel, no current is proactively driven through the channel other than noise generated in the system. For example, the observation channel may be decoupled from a current source used to send signals to a corresponding pixel to cause the pixel to display data. The current sensed on the observation channel is scaled based on a scaling factor determined during calibration (block 126). In some embodiments, the calibration may be repeated prior to each sensing operation to ensure accuracy of the calculations using the scaling factor. The scaled current is then subtracted from the current found in the sensed channel to determine a compensated output (block 128). The compensated output is used to compensate operation of the display (block 130).

Figure 9:
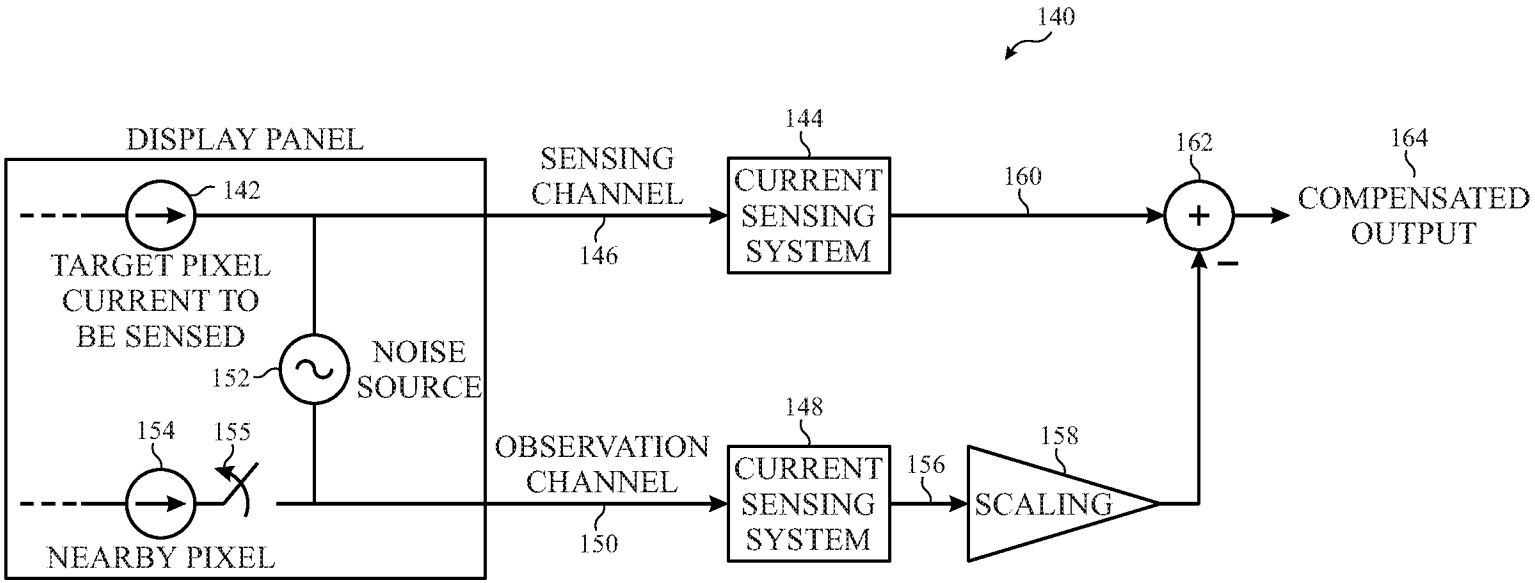
FIG. 9 illustrates a block diagram view of a dual-channel current sensing scheme used in the process of FIG. 8, in accordance with an embodiment.

FIG. 9 illustrates a block diagram view of a dual-channel current sensing scheme 140. As illustrated, a target pixel current is provided via a current source 142. The current provided by the current source 142 then is supplied to a current sensing system 144 via a sensing channel 146. For a pixel near the target pixel, a sensing system 148 is used to detect current through an observation channel 150 that receives current from a noise source 152 (e.g., capacitive coupling). In other words, the observation channel is used to observe noise (e.g., common-mode noise) in the observation channel 150 during driving of the sensing channel 146 to determine a magnitude of the noise (e.g., common-mode noise).

To ensure that only noise is passed through the observation channel 150, the observation channel 150 may be decoupled from a corresponding current source 154 via a switch 155. A sensed observation current 156 is scaled at scaling circuitry 158 and subtracted from a sensed current 160 at summing circuitry 162 to generate a compensated output 164 indicative of current through the sensing channel 146 substantially attributable to the current provided by the current source 142. The scaling factor may be determined in a calibration of the display panel to determine an output of each channel in response to an aggressor image/injected signal to determine channel properties to determine a common-mode error between channels.

Furthermore, the dual-channel current sensing scheme 140 may include amplifiers, filters, analog-to-digital converters, digital-to-analog converters, and/or other circuitry used for processing in the dual-channel current sensing scheme 140 that have been omitted from FIG. 9 for clarity.

Figure 10:
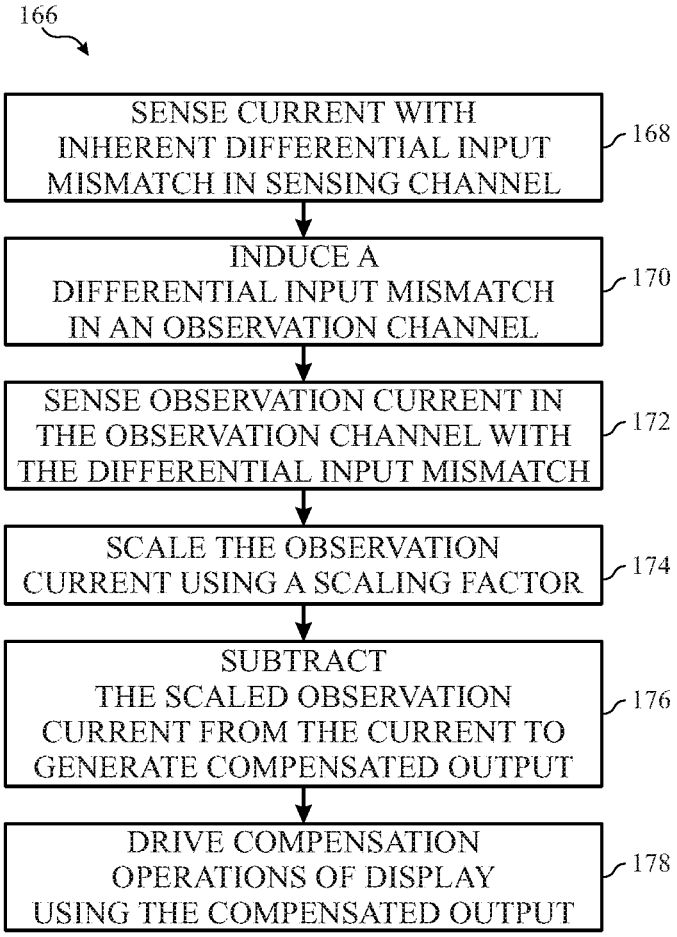
FIG. 10 illustrates a flow diagram of a process 150 for sensing a current using two channels each having differential inputs, in accordance with an embodiment.

Each channel may include differential inputs. In embodiments with differential input channels, a sensing channel may utilize an inherent differential input mismatch while the observation channel may utilize an intentionally induced differential input mismatch to sense a time-correlated common-mode error. FIG. 10 illustrates a flow diagram of a process 166 for sensing a current using two channels each having differential inputs. In a sensing channel, a target current is driven from a current source using and sensed with an inherent differential input mismatch (block 168). An induced differential mismatch is induced in an observation channel (block 170). The observation channel with the induced differential mismatch is used to sense an observation current derived from noise, such as common-mode noise across the observation and sensing channels (block 172). In the observation channel, no current is proactively driven through the channel other than noise generated in the system. For example, the observation channel may be decoupled from a current source used to send signals to a corresponding pixel to cause the pixel to display data. The observation current sensed on the observation channel is scaled using scaling factor (block 174). As discussed below in relation to FIGS. 12 and 13, the scaling factor may be determined from a calibration of the display panel. The scaled current sense is subtracted from the sensed channel to determine a compensated output (block 176). The compensated output is used to drive compensation operations of the display (block 178).

Figure 11:
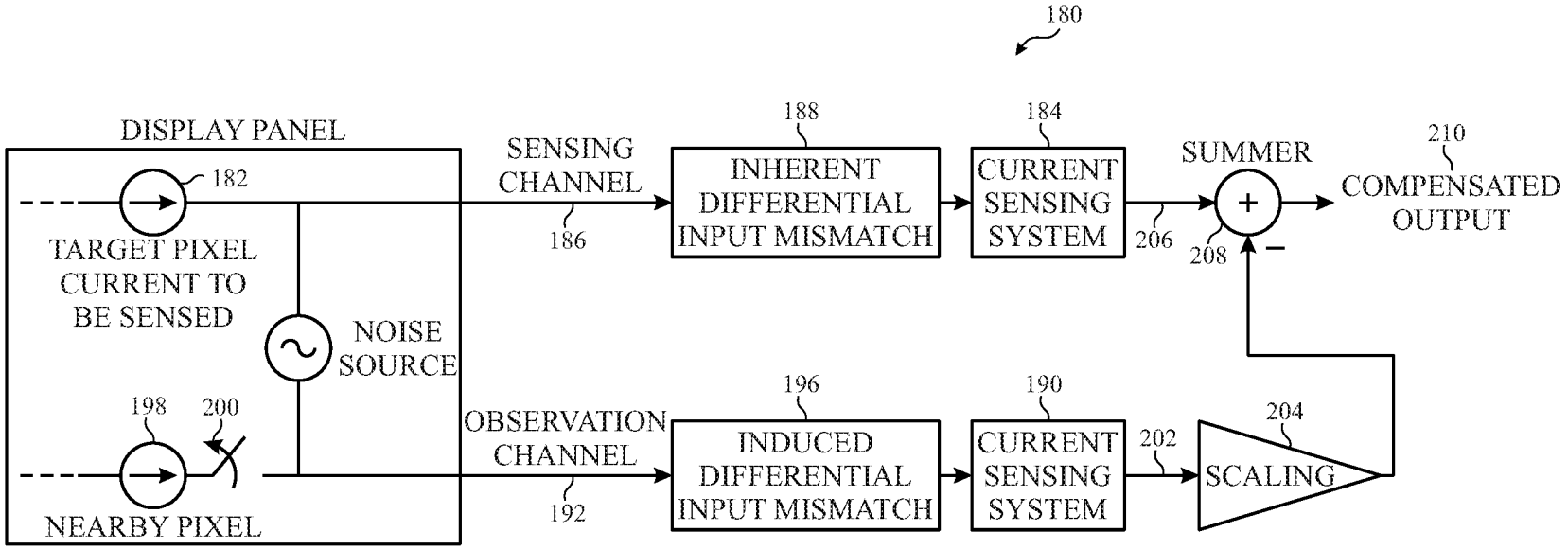
FIG. 11 illustrates a block diagram view of a dual-channel current sensing scheme with differential input channels employing the process of FIG. 10, in accordance with an embodiment.

FIG. 11 illustrates a block diagram view of a dual-channel current sensing scheme 180 with differential input channels. As illustrated, a target pixel current is provided via a current source 182. The current provided by the current source 182 then is supplied to a current sensing system 184 via a sensing channel 186. The sensing channel 186 includes differential inputs with some inherent differential input mismatch 188 inherent in the sensing channel 186.

For another pixel (e.g., a pixel near to the target pixel), a sensing system 190 is used to detect current through an observation channel 192 that receives current from a noise source 194 (e.g., capacitive coupling). The observation channel 192 includes an induced differential input mismatch 196 that is induced to sense a time-correlated common-mode error with the sensing channel 186. In other words, the observation channel 192 is used to observe noise (e.g., common-mode noise) in the observation channel 192 during driving of the sensing channel 186 to determine a magnitude of the noise (e.g., common-mode noise).

To ensure that only noise is passed through the observation channel 192, the observation channel 192 may be decoupled from a corresponding current source 198 using a switch 200. The current source 198 is used to supply data to a pixel corresponding to the observation channel 192. A sensed observation current 202 is scaled at scaling circuitry 204 and subtracted from a sensed current 206 at summing circuitry 208 to generate a compensated output 210 indicative of current through the sensing channel 186 substantially attributable to the current provided by the current source 182.

Furthermore, the dual-channel current sensing scheme 180 may include amplifiers, filters, analog-to-digital converters, digital-to-analog converters, and/or other circuitry used for processing in the dual-channel current sensing scheme 180 that have been omitted from FIG. 11 for clarity.

Figure 12:
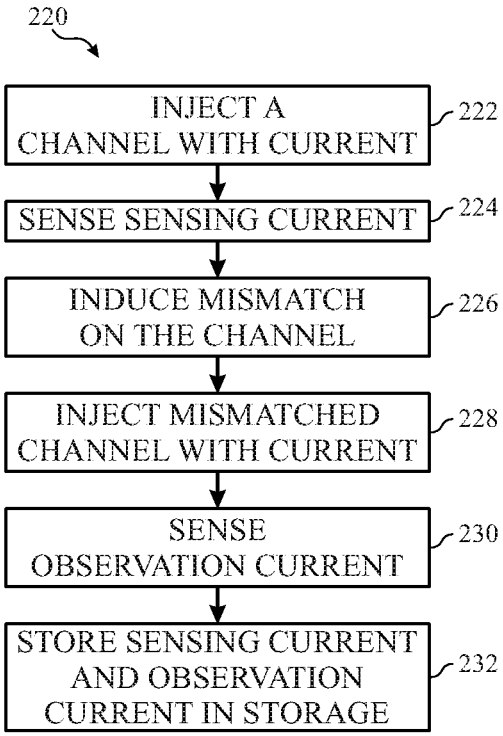
FIG. 12 illustrates a flow diagram of a process for calibrating the noise compensation circuitry to determine a scaling factor used in the process of FIG. 8 or 10, in accordance with an embodiment.

The scaling factor may be determined in a calibration of the display panel to determine an output of each channel in response to an aggressor image/injected signal to determine channel properties to determine a common-mode error between channels. FIG. 12 illustrates a flow diagram of a process 220 for calibrating the noise compensation circuitry. For a plurality of channels in a display, inject a channel with a current with an inherent differential input mismatch (block 222). The current may be set using an aggressor image and/or injected signal setting a value for the pixel corresponding to the channel. A first output is sensed for the channel based on the current through the channel with the inherent differential input mismatch (block 224).

The channel is also tested with an induced differential mismatch by inducing a differential mismatch in the channel (block 226). While in the induced mismatch state, the current (e.g., using the same aggressor image/injected signal) is passed into the channel (block 228). A second output is sensed for the channel based on the current through the channel with the induced mismatch (block 230).

Once these outputs are obtained for each channel to be calibrated, the outputs are stored in a lookup table used to establish the scaling factors (block 232). For instance, the first output of the sensed channel ($G_{si}$) is stored for each channel in an inherent differential sensing mode, and the second output of the sensed channel ($G_{oi}$) is stored for each channel in an induced differential observing mode. The storage of these values may be stored in a lookup table, such as that shown below in Table 1.

TABLE 1

| Lookup table for calibration outputs | | | | | | |
|---|---|---|---|---|---|---|
| | Channel | | | | | |
| | 1 | 2 | 3 | 4 | . . . | n |
| Inherent Mismatch | $G_{s1}$ | $G_{s2}$ | $G_{s3}$ | $G_{s4}$ | . . . | $G_{sn}$ |
| Induced Mismatch | $G_{o1}$ | $G_{o2}$ | $G_{o3}$ | $G_{o4}$ | . . . | $G_{on}$ |

These stored outputs may be used to determine a scaling factor using a relationship between outputs of a sensing channel and an observational channel. For example, the scaling factor that is used to scale observation channel sensed currents may be determined using the following Equation 1:

$$SF_{ij} = \frac{G_{oj}}{G_{si}}, \qquad \text{(Equation 1)}$$

where channel i is the sensing channel, channel j is the observational channel, $SF_{ij}$ is the scaling factor used to scale an output of the observational channel j when sensing via channel i, $G_{oj}$ is the output of channel j during induced differential mode calibration, and $G_{si}$ is the output of channel i during inherent differential mode calibration. As previously discussed, the scaling factor is used to scale the observational channel output before subtracting from the sensing channel output to ensure that the resulting compensated output is substantially attributable to the sensing channel's effects on the current through channel without inappropriately applying common-mode noise to the compensation.

In some embodiments, calibration measurements may be conducted multiple times to average the results to improve a signal-to-noise ratio of the outputs.

Figure 13:
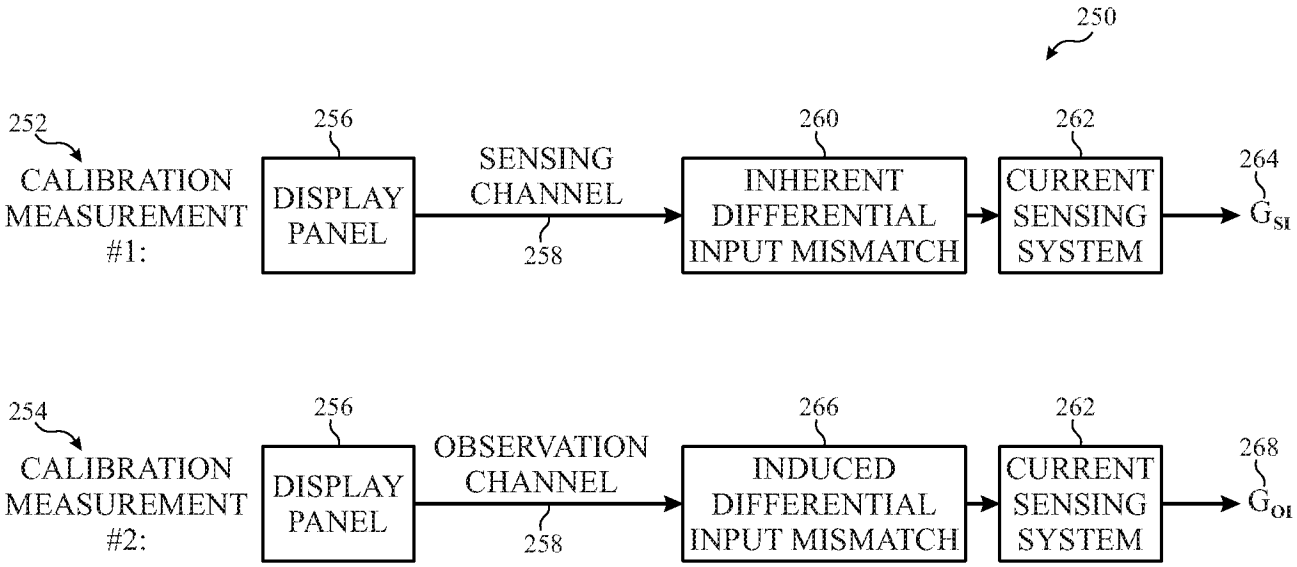
FIG. 13 is a block diagram view of calibration scheme used in the process of FIG. 12, in accordance with an embodiment.

FIG. 13 is a block diagram view of calibration scheme 250. As illustrated, the calibration scheme 250 includes calibrating values for each channel in a sensing channel mode 252 and an observation channel mode 254.

The sensing channel mode 252 generates a current that is sent through a channel of the display panel 256 corresponding to one or more pixels that is sensed through a sensing channel 258 having an inherent (e.g., non-induced) amount of differential input mismatch 260. The current through the channel 258 having the inherent differential input mismatch 260 is sensed at a current sensing system 262 producing an output ($G_{si}$) 264 that is stored in memory (e.g., lookup table illustrated in Table 1) for the inherent mismatch value used in scaling factor calculations.

During another calibration step before or after sensing channel mode 252 analysis, an observational channel mode 254 is employed. In the observational channel mode 254, the same current is generated (e.g., using the same image or injected signal). However, the sensing channel 258 is now equipped with an induced differential input mismatch 266. The amount of mismatch may be an amount of mismatch used in the observational channel operation during dual-channel sensing previously discussed or may differ to tune the scaling factor. The current in the channel 258 with the induced differential input mismatch 266 is sensed using the current sensing system 262 and an output ($G_{oi}$) 268 is stored in memory (e.g., lookup table illustrated in Table 1) for the induced mismatch in scaling factor calculations.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A method comprising:

sensing a current in a sensing channel of a display;

inducing a differential input mismatch in an observation channel of the display to a level above an differential inherent mismatch in the observation channel;

sensing an observation current from noise in the observation channel of the display based at least in part on the differential input mismatch;

scaling the observation current to generate a scaled observation current;

subtracting the scaled observation current from the sensed current to generate a compensated output; and driving compensation operations of the display based at least in part on the compensated output.

2. The method of claim 1, wherein the sensed channel comprises a channel corresponding to a pixel of the display.

3. The method of claim 2, wherein the observation channel comprises a channel corresponding to a nearby pixel of the display near to the pixel.

4. The method of claim 3 comprising decoupling the observation channel from a current source configured to supply current to the nearby pixel.

5. The method of claim 1 comprising calibrating the display, wherein calibrating the display comprises calculating a scaling factor used in scaling the observation current.

6. The method of claim 5, wherein the scaling factor is based at least in part on a first calibration output of the sensing channel and a second calibration output of the observation channel during calibration of the display performed prior to sensing the current and sensing the observation current.

7. The method of claim 6, comprising inducing a differential input mismatch in the observation channel during calibration.

8. The method of claim 6, wherein the scaling factor is calculated using:

$$SF_{ij} = \frac{G_{oj}}{G_{si}},$$

wherein SFij is the scaling factor for the sensing channel i and the observation channel j, Goj is the second calibration output of the observation channel j, and Gsi is the first calibration output of the sensing channel i.

9. The method of claim 5, wherein calibrating the display comprises determining a sensing channel calibration output and an observation channel calibration output for each channel of a plurality of channels of the display.

10. The method of claim 1 comprising sensing the current on the sensing channel using only an inherent differential input mismatch in the sensing channel.

11. The method of claim 1, wherein sensing the current and sensing the observation current occur substantially simultaneously.

12. A system comprising:

a display panel;

a first channel configured to sense a sensed parameter sent to a first pixel of a display, wherein the first channel is configured to have only an inherent differential input mismatch during sensing of the first channel;

a second channel configured to sense an observation parameter sent to a second pixel of a display, wherein the second channel is configured be induced with an induced differential input mismatch during sensing of the second channel, wherein the induced differential input mismatch has more differential input mismatch than a level corresponding to an inherent differential input mismatch for the second channel;

scaling circuitry configured to scale the observation parameter;

summing circuitry configured to subtract the scaled observation parameter from the sensed parameter to generate a compensated parameter; and compensation circuitry configured to drive compensation operations of the display based at least in part on the compensated parameter.

13. The system of claim 12, wherein the sensed parameter and the observation parameter comprise current.

14. The system of claim 12, wherein the scaling circuitry is configured to scale the observation parameter using a scaling factor that the scaling circuitry is configure to acquire from a lookup table.

15. The system of claim 14, wherein the lookup table is populated during a calibration mode that stores a sensed calibration output and an observation calibration output for each a plurality of channels including the first and second channels, wherein the sensed calibration output and the observation calibration outputs are generated using a same level of the sensed parameter.

16. The system of claim 15, wherein the sensed calibration output for each of the plurality of channels is generated using only the inherent differential input mismatch, and the observation calibration output for each of the plurality of channels is generated using a calibration induced differential input mismatch.

17. The system of claim 16, wherein the calibration induced differential input mismatch and the induced differential input mismatch include a same level of mismatch.

18. The system of claim 12 comprising a switch configured to decouple a parameter supply from the second pixel during sensing of the first channel.

19. A method comprising sensing a current in a sensing channel of a display having an inherent differential input mismatch;

inducing an induced differential input mismatch in an observation channel of the display to a level higher than an inherent amount of differential input mismatch for the observation channel;

sensing an observation current from noise in the observation channel;

scaling the observation current to generate a scaled observation current using a scaling factor based at least in part on a sensing calibration value corresponding to the sensing channel determined during a calibration mode and an observation calibration value corresponding to the observation channel determined during the calibration mode;

subtracting the scaled observation current from the current to generate a compensated output; and compensating operation of the display based at least in part on the compensated output.

* * * * *